US006272988B1

(12) United States Patent
Garland et al.

(10) Patent No.: US 6,272,988 B1
(45) Date of Patent: Aug. 14, 2001

(54) DEVICE FOR CLEANING BEARER SURFACES ON ROTATING CYLINDERS

(75) Inventors: Wayne Harvey Garland, Dover; Chris Alan Cloutier, Barrington; Michael Alexander Novick, New Durham, all of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/291,460

(22) Filed: Apr. 14, 1999

(51) Int. Cl.[7] ..... B41F 35/00
(52) U.S. Cl. ..... 101/425; 101/423
(58) Field of Search ..... 101/425, 423

(56) References Cited

U.S. PATENT DOCUMENTS 2,330,491 9/1943 Huck .
3,952,654 4/1976 Evans .
4,162,652 7/1979 Rebel et al. .
4,704,964 11/1987 Robertson .
4,893,562 1/1990 Robertson .
5,809,050 9/1998 Baldwin et al. .

*Primary Examiner*—John S. Hilten
*Assistant Examiner*—Darius N. Cone
(74) *Attorney, Agent, or Firm*—Kenyon & Kenyon

(57) ABSTRACT

A printing unit includes rotating blanket cylinders (4, 5) and rotating plate cylinders (6, 7). Said rotating cylinders (4, 5; 6, 7) each have bearers (16) assigned to respective front sides thereof. Surface cleaning units (11) are assigned to respective surfaces (17, 34) of said bearers (16), said cleaning units (11) having quick clamps (21, 22; 27, 28) for quick clamping of wiper elements (12).

13 Claims, 4 Drawing Sheets

DEVICE FOR CLEANING BEARER SURFACES ON ROTATING CYLINDERS

FIELD OF THE INVENTION

The present invention is related to a device for cleaning bearing surfaces on rotating cylinders such as bearers in rotary printing presses for commercial and newspaper applications.

BACKGROUND OF THE INVENTION

U.S. Pat. No. 3,952,654 is related to an automatic blanket wash-up system. An attachment for cleaning cylindrical surfaces such as the surface of an offset printing press blanket cylinder includes a sponge unit mounted in proximity to the cylindrical surface to be cleaned. The sponge unit is supported by a pair of pneumatic cylinders which when activated cause the sponge to bear in wiping engagement against the cylinder. A single elongated spray tube containing two sets of orifices, one set facing the sponge unit and the other set facing the cylinder, is mounted on the sponge unit and connected to a source of cleaning solvent under pressure. During a cleaning operation, the solvent is directed through the orifices of the spray tube towards both the sponge unit and the cylindrical surface adjacent the nip. The concentration of the solvent spray at this location results in the sponge cleaning the cylindrical surface without streaking. The sponge unit mounts on an elongated angle bracket and the spray tube is in turn mounted on the sponge unit. A plurality of screw and wing nut assemblies is used to mount the sponge and the spray tube to permit a quick release and disassembly of the apparatus for maintenance. An upright shield isolates the cleaning attachment from the remainder of the press to prevent any flying particles from contaminating the ink roller system. An integrated control system provides simultaneous pressurization of the solvent reservoir, the spray apparatus and the pair of cylinders that move the sponge against the surface.

U.S. Pat. No. 2,330,491 is related to a cylinder bearer lubricator in a printing machine having cooperating cylinder bearers, having peripheral phases and adapted to rotate with their peripheral phases in rolling engagement under pressure. A yielding lubricating wick is supported in wiping engagement with the peripheral phase of a bearer and means for supplying lubricant to the wick, whereby the wick deposits the requisite quantity of lubricant on the peripheral phase of the bearer to provide a lubricate cushion and to reduce friction at the contacting areas of the cooperating bearers.

U.S. Pat. Nos. 4,704,964 and 4,893,562 each relate to a bearer wiper assembly. This bearer wiper assembly includes independent extensible arms in the form of pneumatic rams provided for each printing press bearer. The pneumatic rams are pivotally mounted to a support bracket in swing-away relation and a bearer wiper unit is provided at the remote end of each ram. The rams are releasable held in place by a latching mechanism and each wiper unit includes by an ell-shaped pad releasable clamped to a mounting frame carried by each ram. The bearer-engageable portion of each pad is apertured to collect foreign particular matter from the bearers.

U.S. Pat. No. 4,162,652 is related to a device for cleaning cylinder bearers on printing presses. A device for continuously cleaning a bearer in a printing press includes a carrier in the form of a plate pivoted on the frame for the movement toward and away from the bearer. Mounted on the end portion of the carrier and oriented in a generally axial direction, is a first scraper in the form of a doctor blade of stiff but wearable material and a second scraper in the form of a relatively soft lubricated bar of felt, the carrier being biased for simultaneous contact of the scrapers against the bearer surface. The first scraper is oriented at a slight angle with respect to the bearer axis so that the material which is scraped from the bearer tends to be urged sideways for continuous discharge. The second scraper occupies a pocket in the carrier so that it may be rotationally indexed into a new position in the pocket as its presented edge becomes worn. A first stop interposed in the path of movement of the carrier prevents the carrier from scraping against the surface of the bearer as the scrapers are worn away. A second or latching stop is provided for latching the carrier in upraised position against the bias force to facilitate cleaning the cylinder.

U.S. Pat. No. 5,704,290 is related to a device for cleaning bearing surfaces on rotating cylinders. Disclosed is a device for cleaning cylinder bearers of rotary printing unit cylinders having cylinder bearers mounted at respective end phases of at least two of the cylinders for attaining a defined spacing between respective axis of the two cylinders. The cylinder bearers are rotatable with the two cylinders, respectively, and are rollable on one another while being in continuous contact with one another. The device includes at least one cleaning element movable into engagement with the bearing surface of one of the cylinder bearers, respectively, by a pressure medium and movable away from the bearing surface. The cleaning element is impregnatable with a fluid.

Existing bearer wipers are inserted through slots and sheet material guards and clamp with the spring grip. Due to neglected maintenance they are difficult to replace. Neglecting of maintenance of said bearer wipers eventually may cause bearer failure.

SUMMARY OF THE INVENTION

One object of the present invention to provide for quick clamping and replacement of wiper components in bearer surface cleaning units of a rotary printing press.

According to the present invention a printing unit includes:

- rotating blanket cylinders and rotating plates cylinders;
- said rotating cylinders each having bearers assigned thereto; and
- surface cleaning units assigned to respective surfaces of said bearers, said cleaning units having quick clamps for quick clamping of wiper elements.

The solution according to the present invention comes along with several advantages.

By using said quick clamps in both embodiments depicted in the present invention, a sufficient clamping force is exerted upon the wiper components preventing them from being pulled onto the surface of the bearers which have to be cleaned. By having the quick clamps perform a rotational movement, the wiper components are subjected to a defined clamping force in their engaged position automatically without having the operator perform any adjustments.

According to a first embodiment of the present invention, the quick clamps are attached to a retaining body. The retaining body may comprise an opening which, for instance, extends in vertical direction. The quick clamps may be movably arranged within said opening. Said quick clamps furthermore release the wiper component in a respective disengaged position and allows for easy replacement thereof by the press operator. In an engaged position which is achieved by rotational movement of said quick clamps a defined clamping force is exerted upon said wiper component. In the first embodiment of the present invention the quick clamps are shaped as a first and a second pinching surface, respectively. A clamping force is created upon a rotational movement of the pinching surfaces within the opening without requirement of any adjustments by the pressman. Furthermore, said clamping force is maintained upon movement of the wiper component into its respective engaged position opposite a bearer surface to be cleaned.

In a second embodiment of the present invention the quick clamps may be shaped as an eccentric which is movably mounted with respect to a clamping bar which is fixed. Upon rotational movement of said eccentric about a pivot axis, the wiper component is clamped against said fixed clamping bar. A pivot axis about which the eccentric is movable, is offset to a respective center of the eccentric. In the second embodiment a clamping force is exerted upon said wiper component by creating an interference between the wiper component and a respective surface portion of the eccentric.

The present invention is particularly useful for applications in newspaper or commercial press applications, regardless whether sheet-fed or web-fed.

BRIEF DESCRIPTION OF THE DRAWINGS

The present invention, both as to its construction and its method of operation together with additional objects and advantages thereof, will be best understood from the following description, in which.

DETAILED DESCRIPTION

Figure 1:
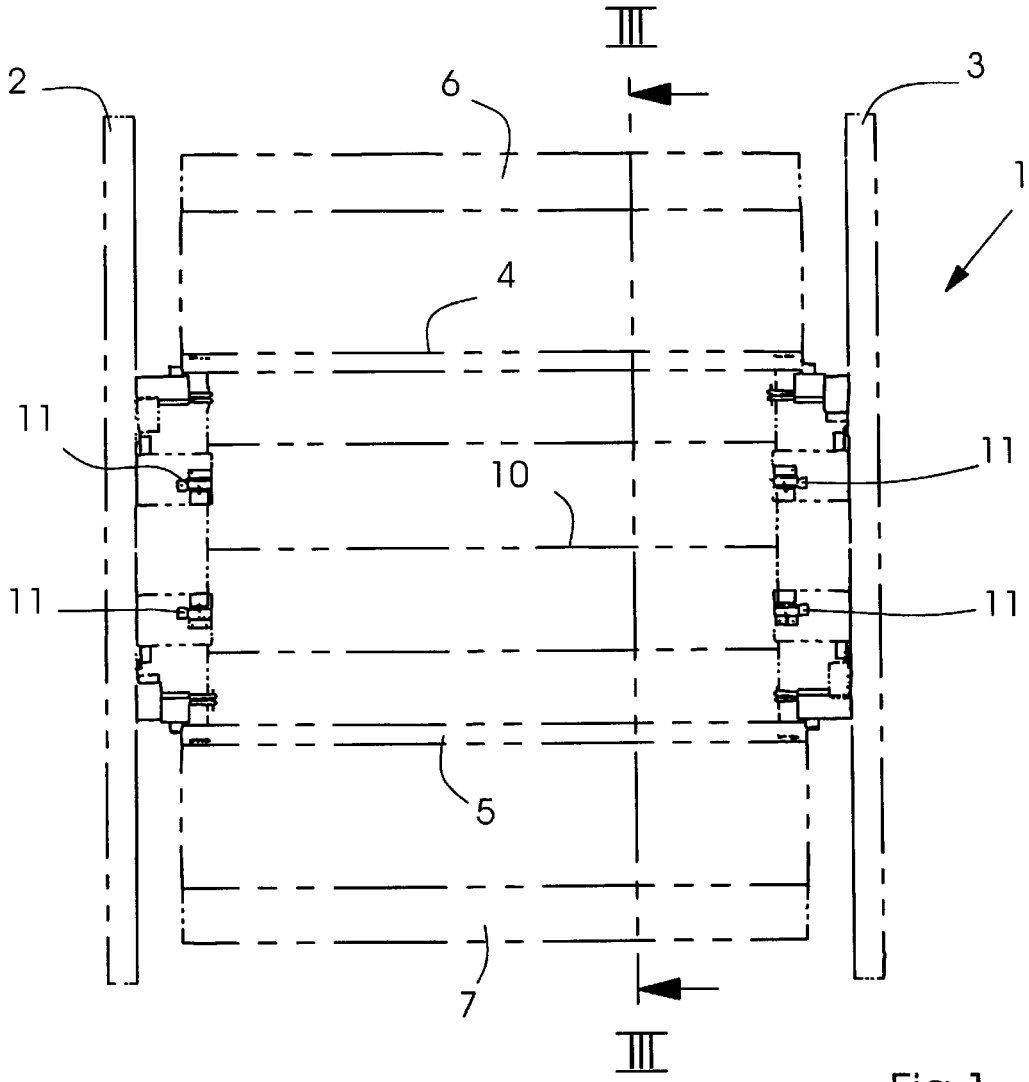
FIG. 1 shows a top view of a printing unit as used for newspaper applications.

FIG. 1 shows a top view of a printing unit as used for newspaper applications.

Figure 3:
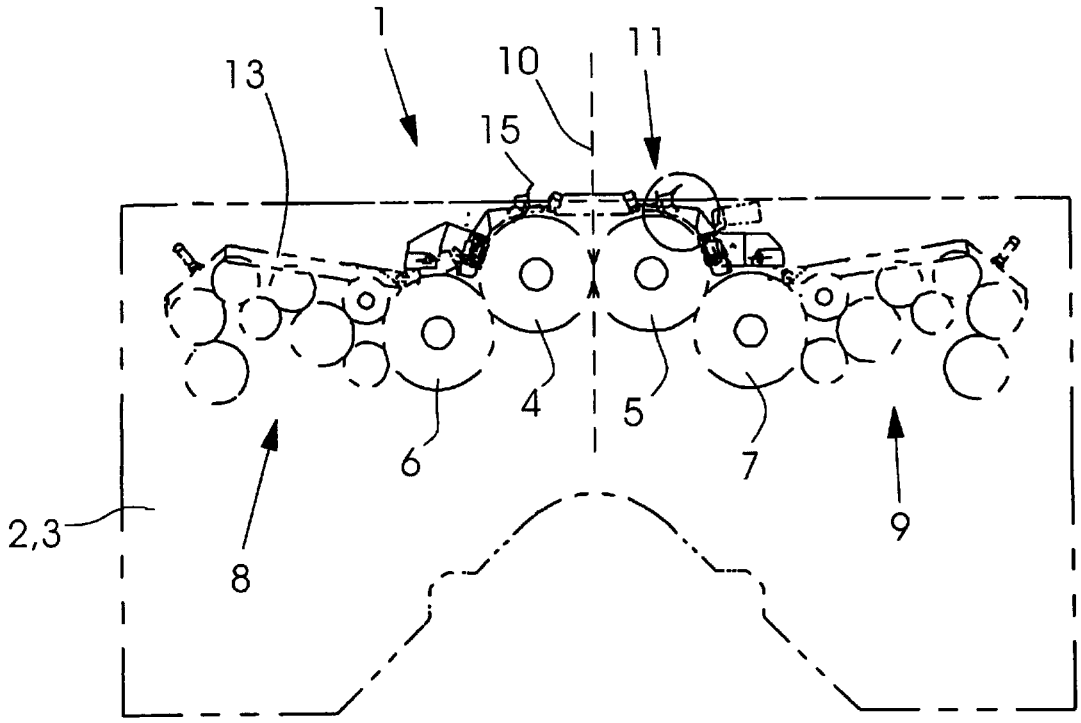
FIG. 3 is a side view of a printing unit according to FIG. 1.

The top view of a printing unit according to FIG. 1 discloses a printing unit 1 having two side walls 2, 3 respectively, within which rotating cylinders 4, 5, 6 and 7 are mounted (See also FIG. 3). Between the rotating cylinders 4, 5, respectively, which may be blanket cylinders in an offset printing press, a web travel plane 10 is defined extending perpendicular to the drawing plane of FIG. 1. Said rotating cylinders 6, 7, respectively, are plate cylinders which may receive printing plates, the printing plates either being arranged one adjacent to the other across the width of said plate cylinders or about the circumference of said plate cylinders 6, 7, respectively. Reference numeral 11 denotes the bearer surface cleaning units 11 assigned to a surface 17 of a respective bearer 16 (see FIG. 5). Bearers 16 are mounted on the front portions of each of said rotating cylinders 4, 5, 6, and 7, respectively.

Figure 2:
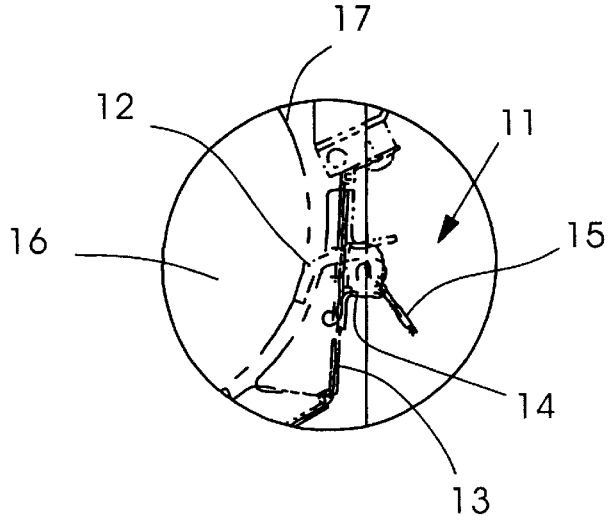
FIG. 2 is a detail of a printing unit bearer surface cleaning element with a quick clamp of the present invention.

FIG. 2 shows bearer surface cleaning units of the printing unit in greater detail.

Figure 4:
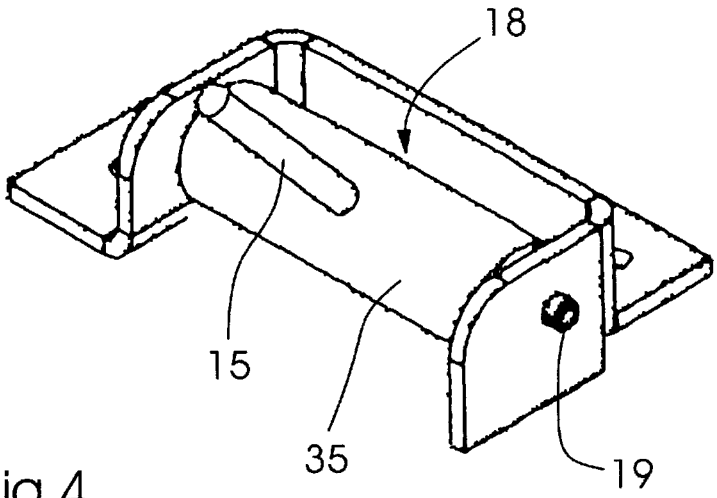
FIG. 4 is a perspective view of a quick clamp for a wiper element of the present invention.

Within a cage like support 14, a retaining element 20 is mounted, as shown in FIG. 4. The retaining rod 35 is movable by a quick release pin 15. The retaining rod 35 fixes a strip-like wiper element 12 between its surface and a respective surface portion of said support 14. Said wiper element 12 is shown in FIG. 2 as to contact over a portion of its length the surface 17 of bearer 16. The surface 17 of said bearer 16 tends to pull the wiper element 12 towards its surface through said previously mentioned slot between the retaining rod 35 and this surface of said support 14. With this design, the clamping force exerted upon said wiper element 12 can be increased by quick release pin 15 to prevent slippage thereof through said slot-shaped opening between said retaining rod 35 and the respective surface portion of said support 14.

FIG. 3 in further detail shows a side view of a printing unit.

Said printing unit 1 having two side walls 2, 3 respectively has a right hand side and a left hand side printing cylinder couple 4, 6 and 5, 7 respectively, extending on both sides of said web travel plane 10.

Said plate cylinder 6 receives ink from an inker 8 being, being covered by a guard 13; said rotating cylinder couple 5, 7 on the other hand is supplied with ink from an inker 9 being protected by a guard 13. On top of said side walls 2, 3, respectively, surface cleaning units 11 are mounted assigned to bearers 16 mounted on respective front portions of said blanket cylinders 4, 5, respectively. Reference numeral 15 depicts a pin through which a wiper element 12 assigned to said cleaning unit 11 is mounted within said surface cleaning units 11. Said inkers 8, 9, respectively, not described in greater detail herein-to-fore, are short inkers, i. e. having a relatively low number of rollers assigned thereto.

FIG. 4 discloses a perspective view of a quick release support for the wiper element.

Said support 14 of said surface cleaning unit 11 as shown in FIG. 2 includes a retaining body 20 being rotatably mounted upon an axis 19. Said retaining body 20 is movable using the pin 15. Between a surface of the retaining rod 35 and one surface of said support 14, a slot 18 is provided, receiving said strip-shaped wiper element 12 (see FIG. 2).

Figure 5:
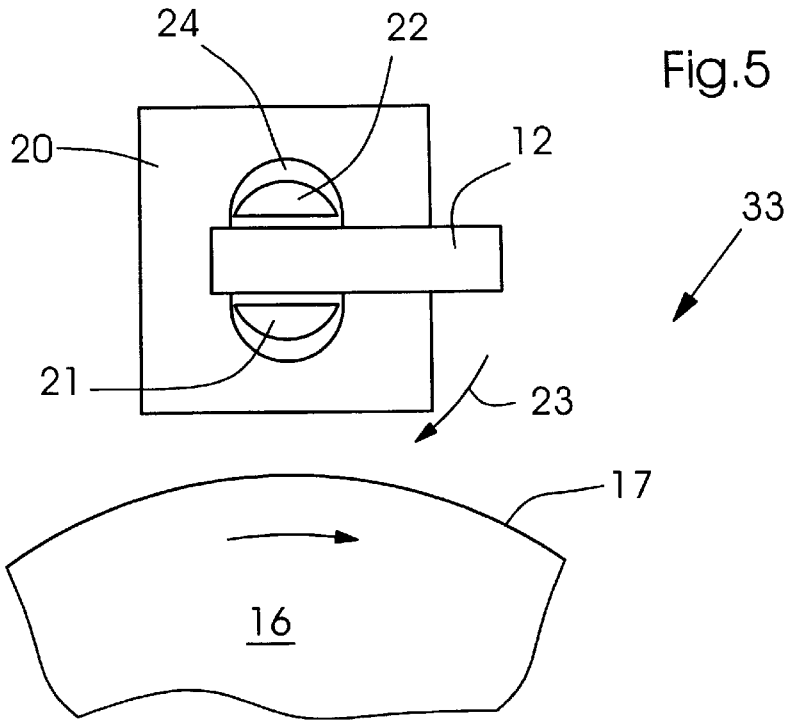
FIG. 5 shows a quick clamp of the present invention in disengaged condition.

FIG. 5 shows a quick clamp according to the present invention in its disengaged position.

A retaining body 20 is arranged in the vicinity of a surface 17 of bearer 16. Said retaining body 20 includes an opening within which a first and a second pinching surface 21, 22, respectively, are arranged. By rotational movement of said wiper component 12 in the sense of movement as denoted by reference numeral 23 and the accompanying arrow, said wiper component's 12 lower portion contacts the surface 17 of a respective bearer 16 as depicted in FIG. 6.

Figure 6:
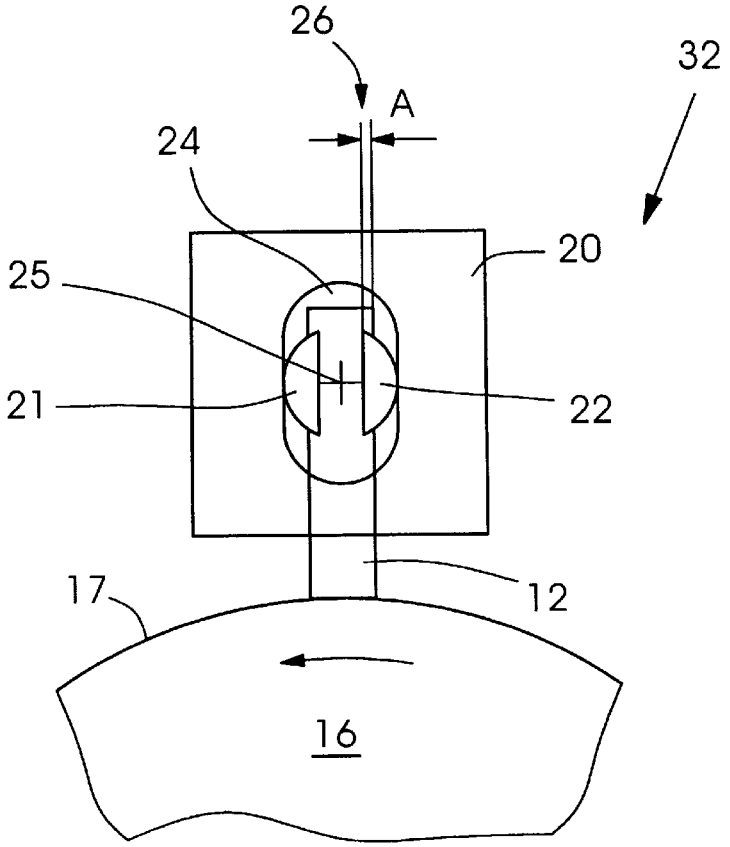
FIG. 6 shows a quick clamp according to FIG. 5 in engaged condition.

In FIG. 6 a quick clamp according to the present invention is shown in its respective engaged position.

In this configuration said quick clamps 21, 22 are shown in the respective engaged position 32; FIG. 5 reflects said disengaged position denoted by reference numeral 33. In FIG. 6, however, said wiper component 12 is turned into its respective vertical extending position, thus contacting the surface 17 of bearer 16. It can be derived from FIG. 6 of the present application that by said first and second pinching elements 21, 22, which also turn when the wiper 12 is turned, a high clamping force can be exerted upon said wiper element 12. The interference between said wiper element 12 in its dimension in the disengaged position and its dimension in the engaged position is depicted by reference numeral 26 or letter A. The rotational movement of said wiper component 12 in direction of arrow 23 is achieved by turning of the wiper components 12 center, denoted with reference numeral 25. Thus, a fast and easy engagement of wiper components 12 can be achieved by this first embodiment of the present invention, using two pinching surfaces 21, 22, respectively, movably arranged within an opening 24 of a respective and retaining body 20.

Figure 7:
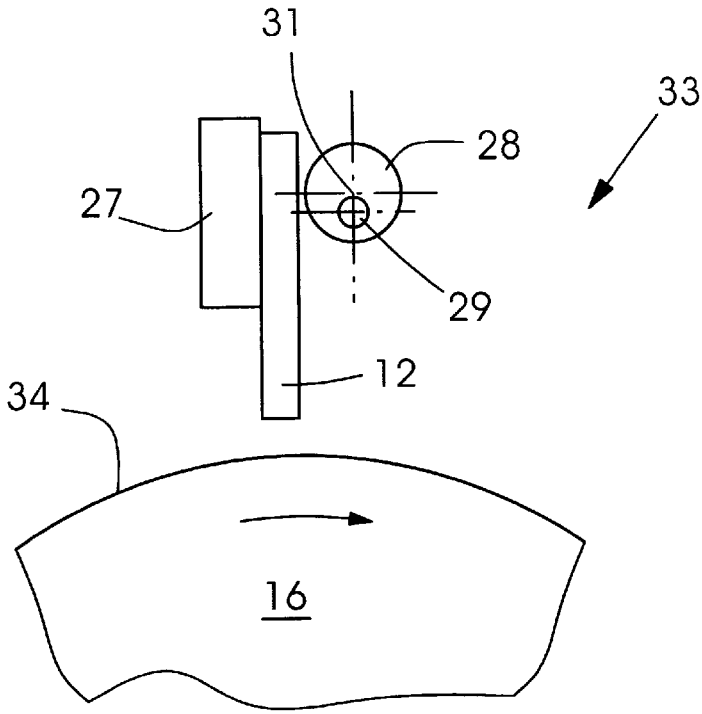
FIG. 7 shows a further embodiment of a quick clamp in a disengaged position.
Figure 8:
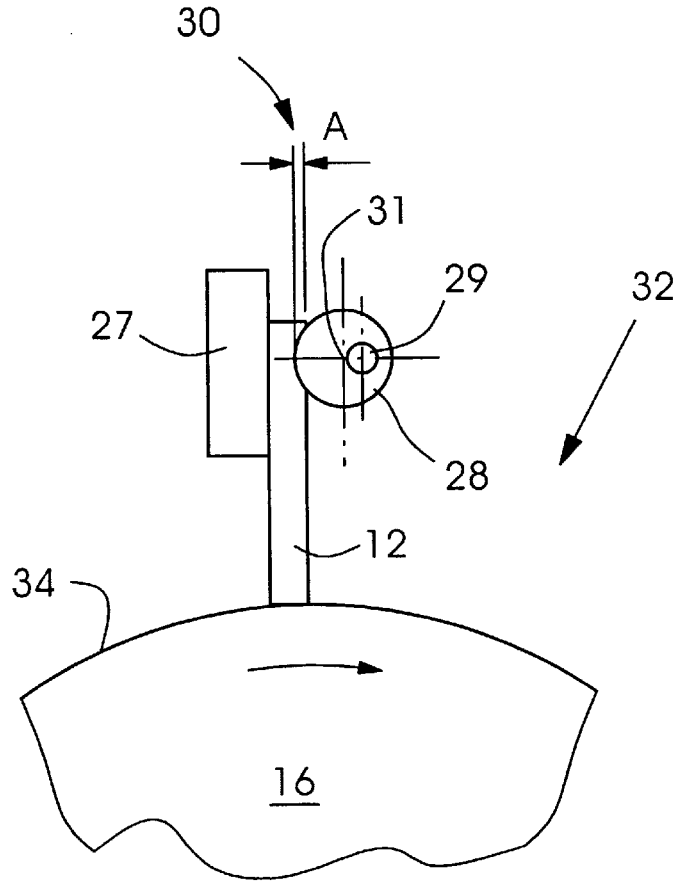
FIG. 8 shows the quick clamp according to FIG. 7 in an engaged position.

A second embodiment of quick a clamp according to the present invention is shown in FIGS. 7 and 8.

Opposite a clamping bar arrangement 27, an eccentric 28 is arranged being pivotable about a pivot axis 29. Said respective pivot axis 29 is arranged in a distance to a respective center 31 of said eccentric 28. When the wiper component 12 is not contacting a surface 34 of a bearer 12, the eccentric 28 is in its disengaged position, being rotated away about its pivot axis 29 from said clamping bar 27. By having said wiper component 12 moved towards said surface 34 of said bearer 16, the wiper component 12 contacts the respective surface 34 of said bearer s 16 surface 34. Then, said eccentric 28 is rotated, thus clamping a top portion of said wiper component 12 against said clamping bar 27, as shown in FIG. 8. In said engaged position 32, an interference 30 of width A is created resulting in a clamping force between said clamping bar 27 and said wiper component 12, fixing said wiper component 12 in a defined position with respect to the respective surface 34 of a bearer 16 assigned to a printing unit cylinder 4, 5, 6, 7, respectively.

Said wiper components 12 seized by said pinching surfaces 21, 22, respectively, in the first embodiment or by said eccentric 28 cooperating with said clamping bar 27 in the second embodiment can quickly and easily be replaced. The wipers 12 can even be connected to a lubricating source to have said quick clamped wiper components 12 applied with a lubricant such as oil.

LIST OF PARTS

1 printing unit
2 side wall
3 side wall
4 blanket cylinder
5 blanket cylinder
6 plate cylinder
7 plate cylinder
8 inker
9 inker
10 web travel plane
11 surface cleaning element
12 wiper component
13 guard
14 retaining element
15 pin
16 bearer
17 bearer surface
18 slot
19 axis
20 retaining body
21 first pinching surface
22 second pinching surface
23 sense of movement
24 opening
25 center B
26 interference A
27 clamping bar

What is claimed is:

1. A printing unit comprising:

rotating blanket cylinders;

rotating plate cylinders;

a bearer assigned to each of the rotating plate and blanket cylinders; and a surface cleaning unit assigned to a surface of at least one of the bearers, the cleaning unit having a quick clamp for quick clamping of a wiper element, the quick clamp having a clamp surface that rotates between a disengaged position in which the wiper element is released by the quick clamp and an engaged position in which the quick clamp through the clamp surface exerts a clamping force on the wiper element.

2. The printing unit according to claim 1, wherein the cleaning units further include a retaining body, the quick clamp being attached to the retaining body.

3. The printing unit according to claim 2, wherein the retaining body has an opening.

4. The printing unit according to claim 3, wherein the quick clamp is movably arranged within the opening.

5. The printing unit according to claim 3, wherein the quick clamp includes a first and a second pinching surface.

6. The printing unit according to claim 5, wherein the clamping force is created upon a rotational movement of the quick clamps within the opening.

7. The printing unit according to claim 6, wherein the clamping force is maintained upon the wiper element being in an engaged position thereof, the quick clamp in the engaged position being rotated about 90° from a disengaged position.

8. A printing unit comprising:

rotating blanket cylinders;

rotating plate cylinders;

a bearer assigned to each of the rotating plate and blanket cylinders; and a surface cleaning unit assigned to a surface of at least one of the bearers, the cleaning unit having a quick clamp for quick clamping of a wiper element, the quick clamp being movable between a disengaged position in which the wiper element is released by the quick clamp and an engaged position in which the quick clamp exerts a clamping force on the wiper element, wherein the quick clamp includes an eccentric movably mounted with respect to a clamping bar.

9. The printing unit according to claim 8, wherein the wiper element is clamped upon rotational movement of the eccentric about a pivot axis.

10. The printing unit according to claim 9, wherein the pivot axis is offset with respect to a center of the eccentric.

11. The printing unit according to claim 9, wherein when the wiper element is clamped, an interference is created between the wiper component and a surface portion of the eccentric.

12. A printing unit for a newspaper applications comprising:

rotating blanket cylinders;

rotating plate cylinders;

bearers assigned to each of the rotating plate and blanket cylinders; and a surface cleaning unit assigned to respective surfaces of each bearer, the cleaning unit having a quick clamp with a clamp surface that rotates for quick clamping of a wiper element.

13. A printing unit comprising:

rotating blanket cylinders;

rotating plate cylinders;

a bearer assigned to each of the rotating plate and blanket cylinders; and a surface cleaning unit assigned to a surface of at least one of the bearers, the cleaning unit having a quick clamp for quick clamping of a wiper element, the quick clamp including a clamping bar and an eccentric movably mounted thereto, wherein the wiper element is clamped upon rotation of the eccentric about a pivot axis.

* * * * *